US005445426A

United States Patent [19]

Sorensen

[11] Patent Number: 5,445,426

[45] Date of Patent: Aug. 29, 1995

[54] METHOD AND APPARATUS FOR LIFTING ROLLS OF CARPET OR THE LIKE

[76] Inventor: Brad A. Sorensen, 253 W. 200 North, Vernal, Utah 84078

[21] Appl. No.: 293,662

[22] Filed: Aug. 22, 1994

[51] Int. Cl.[6] ..... B66C 1/16; B66C 1/66

[52] U.S. Cl. ..... 294/67.3; 294/81.5

[58] Field of Search ..... 294/67.1, 67.3, 67.31, 294/67.33, 67.4, 81.1, 81.2, 81.3, 81.5, 81.51, 81.54–81.56, 82.1, 82.11, 82.13; 414/24.5, 24.6, 910, 911

[56] References Cited

U.S. PATENT DOCUMENTS

| | | | |
|---|---|---|---|
| 1,441,710 | 1/1923 | Parker | 294/81.5 |
| 1,774,623 | 9/1930 | Williams | 294/67.3 X |
| 1,857,091 | 5/1932 | Von der Horst | 294/82.1 X |
| 2,721,757 | 10/1955 | Anderson | 294/81.56 X |
| 3,343,861 | 9/1967 | Sinicki | 294/67.3 X |
| 3,374,964 | 3/1968 | Carvotta . | |
| 3,404,794 | 10/1968 | Wilson . | |
| 3,549,190 | 12/1970 | Caldwell | 294/81.5 X |
| 3,750,811 | 8/1973 | Anderson . | |
| 3,916,801 | 11/1975 | Henderson | 414/911 X |
| 4,088,361 | 5/1978 | Ditcher | 294/82.1 X |
| 4,496,179 | 1/1985 | Ogle . | |

FOREIGN PATENT DOCUMENTS

| | | | |
|---|---|---|---|
| 236196 | 9/1989 | Japan | 294/67.3 |

OTHER PUBLICATIONS

Robert H. Ham Associates, Ltd. 40th Anniversary Wholesale Carpet Industry Supplies 1994 Catalog No. 45–p. 21.

*Primary Examiner*—Johnny D. Cherry
*Attorney, Agent, or Firm*—Mallinckrodt & Mallinckrodt

[57] ABSTRACT

A roll-carrying length of load-supporting structural material having a length substantially equivalent to the length of a heavy roll of carpet or the like to be lifted is adapted to be connected at its opposite ends to an insert tube for the roll by a pair of suspension devices, such as chains, and a pair of relatively short and rigid telescopic inserts for opposite ends, respectively, of the insert tube. Each such telescopic insert is provided with connection structure and is preferably formed therewith as a length member divided by a transverse plate member into inwardly and outwardly extending portions, and an operationally upstanding gusset plate member rigidly secured to the transverse plate member and to and along the outwardly extending portion of the length member. A second suspension device, also preferably of chain formation, is adapted to connect the roll-carrying length to an overhead crane. The method of the invention is concerned with use of the apparatus in lifting and moving heavy rolls of carpet or the like.

4 Claims, 2 Drawing Sheets

METHOD AND APPARATUS FOR LIFTING ROLLS OF CARPET OR THE LIKE

BACKGROUND OF THE INVENTION

1. Field

The invention is in the field of methods and apparatus for lifting heavy rolls of carpet or the like.

2. State of the Art

Rolls of carpet as supplied by the manufacturer to distributors and by distributors to dealers are very heavy (from about 500 to 2,000 lbs.) and require special equipment for lifting and moving them from place to place and for making it easy to unroll the carpet and to cut marketable lengths from the roll.

Various types of apparatus have been developed in the past for the purpose, such as are shown by U.S. Pat. Nos. 3,374,964; 3,404,794; 3,750,811; and 4,496,179. These patents and others that are quite similar indicate that a need for apparatus of the type concerned has existed and that there have been many attempts to fill such need effectively.

SUMMARY OF THE INVENTION

I have now developed what has proven to be a superior way of lifting, moving, and otherwise handling heavy rolls of carpet or the like utilizing a standard overhead hoist such as is already present in many establishments handling heavy rolls of carpet.

The apparatus of the invention comprises a structural carpet roll-insert tube for insertion in and along the length of the standard tube or other axial opening in the roll; a roll-carrying length of structural material that is substantially equivalent in length to that of the carpet roll insert tube; a pair of telescopic, load-bearing inserts for opposite ends, respectively, of the carpet roll insert tube, the outer ends of such telescopic inserts being adapted to have secured thereto selected lengths of roll-lifting chains or other suspension means, which are or may be attached at their upper end portions to corresponding ends of the roll-carrying length of material; and a length of chain or other suspension means fastened to the roll-carrying length and adapted to be fastened to an overhead hoist.

For attaching the roll-lifting chains or other suspension means to the telescopic inserts, such telescopic inserts each comprise a relatively short length of load-bearing material which is preferably provided, between its inner and outer end portions, with a transverse lift plate member and an upstanding gusset plate member, the latter extending along and rigidly attached, as by welding, to the outwardly extending end portion of the relatively short length of load-bearing material.

In accordance with the method of the invention, the structural insertion tube is inserted in the standard axial tube on which the carpet is rolled or in the corresponding axial opening in the roll of carpet. Thereafter, the relatively short telescopic inserts are inserted in opposite ends, respectively, of the structural insertion tube, either with lower ends of the suspension means already attached to outer end portions of the relatively short lengths of load-bearing material, respectively, of such telescopic inserts or attaching them thereto, and then attaching the upper ends of such suspension means to opposite ends, respectively, of the roll-carrying length of structural material. The suspension means for attaching the roll-carrying length of material to an overhead hoist is either already attached to the roll-carrying length or is then attached thereto and to the hoist so the heavy roll of carpet can be lifted and moved from place to place easily and quickly without manual labor.

THE DRAWINGS

The best mode presently contemplated for carrying out the invention in practice is illustrated in the accompanying drawings, in which.

DETAILED DESCRIPTION OF THE ILLUSTRATED EMBODIMENT

Figure 1:
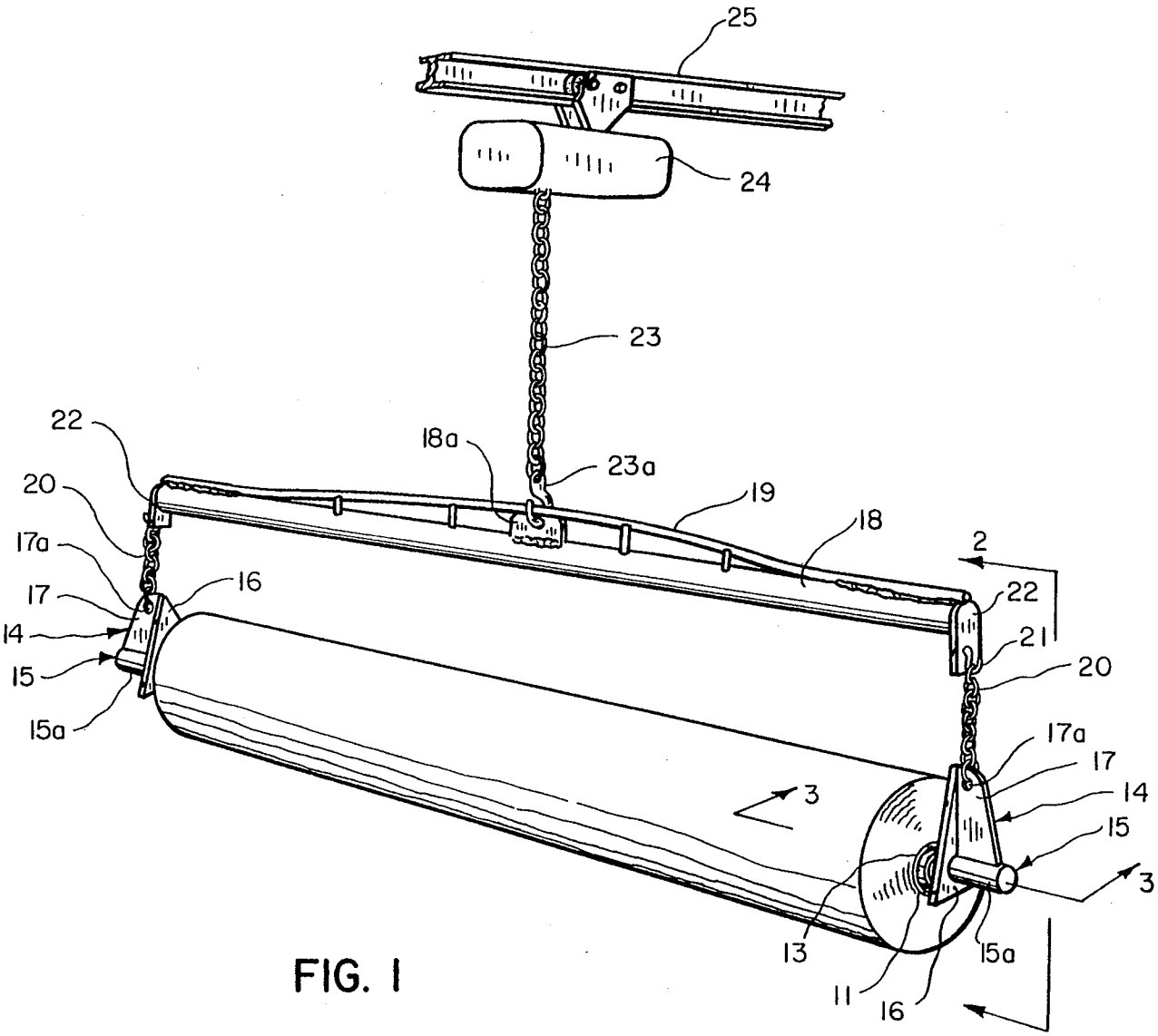
FIG. 1 is a pictorial view of a preferred embodiment of such best mode attached to a typical overhead hoist that is shown schematically and in the act of lifting a heavy carpet roll for movement to a new location or for unrolling for cutting into marketable lengths.
Figure 2:
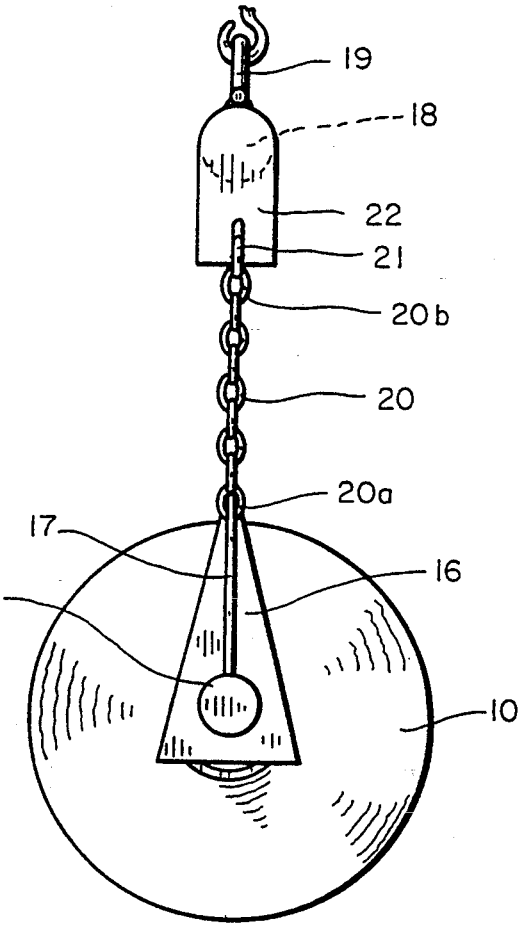
FIG. 2 is an end elevation of the apparatus of FIG. 1 looking from the line 2—2 thereof and drawn to a somewhat larger scale and with parts in the background omitted.

In the form illustrated, the roll 10 of carpet or the like, such as, for example, textile piece goods, contains a usual tube 11 on and along the length of which the carpet is wound as a roll. However, the carpet could less desirably be wound merely upon itself, leaving a similar axial opening.

A structural tube 12, preferably cylindrical and which may be a length of standard steel drill stem, whose length is preferably somewhat greater than the length of the axial opening 13 through the roll 10, is inserted along the length of tube 11 to receive in opposite ends thereof a pair of lifting and carrying telescopic structural inserts 14, respectively.

Figure 3:
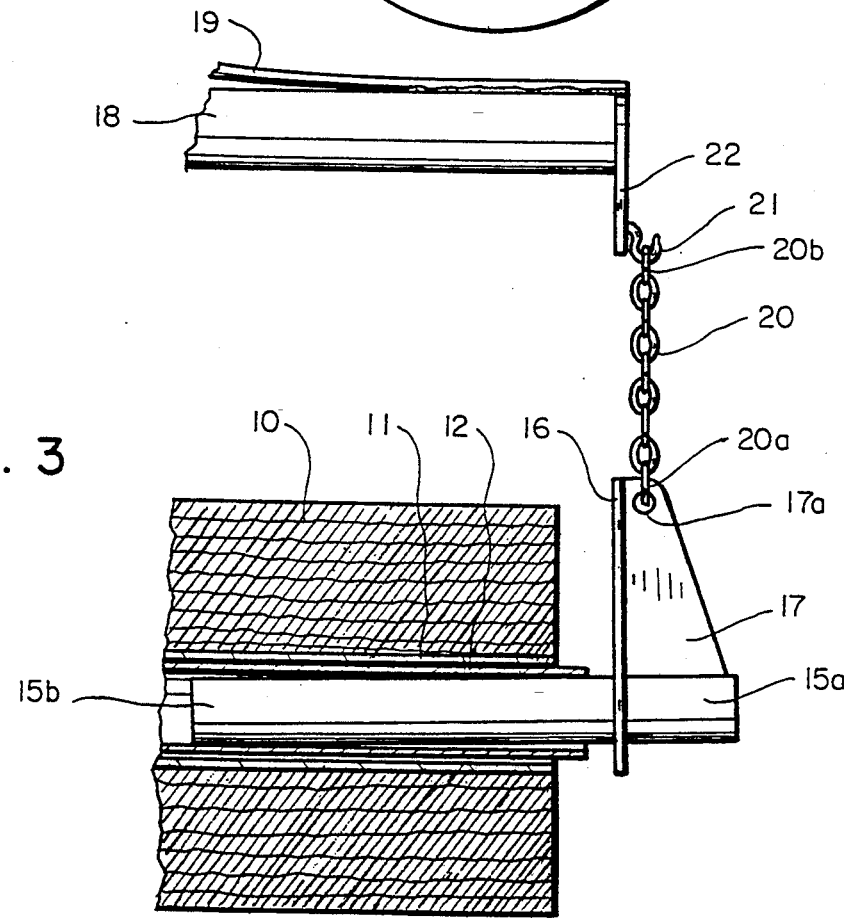
FIG. 3 is a fragmentary, longtiudinal, vertical section taken on the line 3—3 of FIG. 1 and drawn to the scale of FIG. 2.

Such inserts 14 each comprise a relatively short length member 15 (short as compared to the lengths of the carpet roll and its inserted tube 12) of load-bearing rod stock, that is somewhat less in external diameter than the internal diameter of axial tube 12, so as to readily and easily slide thereinto. In the form illustrated, see particularly FIG. 3, a rigid plate member 16 is rigidly secured to, as by welding, and extends traversely across length member 15 to divide the outer end portion 15*a* thereof from the inner end portion 15*b* thereof, see FIG. 3. An upstanding, stiffening gusset plate member 17 is rigidly secured to such plate member 16 as by welding and extends therefrom along and is rigidly secured to the outer end portion 15*a* of length member 15, again as by welding. The telescoping inner end portion 15*b* of length member 15 is sufficiently long to safely engage the corresponding end portion of axial tube 12 for lifting the roll 10. With a roll 10 that is twelve feet in length, the normal tube 11 on which the carpet is rolled being a four inch diameter tube of heavy paperboard and the insert tube 12 being a steel drill stem two and three-eighths inches in outside diameter, with the cylindrical length member 15 of each telescopic insert 14 being a length of pipe one and one-half inches in inside diameter, the outer end portion 15*a* of such length member 15 of each telescopic insert 14 being three inches long, satisfactory results have been obtained with the inner end portion 15*b* of length member 15 extending sixteen inches into the corresponding end of axial tube 12 in the roll 10.

The apparatus of the invention also includes a roll-carrying length 18, preferably a steel tube whose length is about equal to the length of the roll 10 and which is preferably reinforced by truss-like structure 19. A pair of chains each indicated 20, serve as load-supporting suspension means. As here shown, each chain 20 has its lower link 20*a* permanently affixed to the upper end of the corresponding gusset plate member 17 of the corresponding telescopic insert 14, as by means of engagement with a hole 17*a* therein. However, such lower link could be replaced by a hook for insertion in such hole if permanent attachment of the chain to the gusset plate member is not desired, or hole 17*a* could be replaced by a hook for receiving any selected link of the chain. The upper link 20*b* of each chain 20 is shown as engaging a hook 21 that is rigidly fastened to, and projects from, an end plate 22 rigidly fastened, as by welding, to a corresponding end of roll-carrying length 18. Here, any selected link of the chain 20 could engage hook 21 depending upon the effective length desired of such chains 20.

Roll-carrying length 18 is provided with load-supporting suspension means, here shown as a chain 23, FIG. 1, for connection to and for hanging such length 18 from an overhead hoist, here shown schematically at 24, the lower end of chain 23 having a universal type of fitting 23*a* fastened to an attachment lug 18*a* upstanding from the middle of roll-carrying length 18. The upper end of such chain is operatively connected with the lift mechanism of such hoist 24. Any of the several types of commercially available electric or manually operated hoists may be used, for example one of the "CM" hand chain hoists produced by the hoist division of Columbus McKinnon Corporation, Amherst, N.Y., or its "CM Lodestar" ® electric chain hoist indicated in FIG. 1 as trolley-mounted on a trackway beam 25 for travel along such beam.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. In apparatus for lifting heavy rolls of carpet or the like, which apparatus comprises a structural, roll-load-bearing, roll-insert tube having a length substantially equal to that of a roll of carpet or the like to be lifted and of a diameter permitting lengthwise insertion thereof into and along an axial opening in said roll of carpet or the like; a roll-carrying length of structural material whose length is substantially equivalent to that of said roll-insert tube; a pair of relatively short, telescopic inserts for opposite ends, respectively, of said roll-insert tube, each of which inserts has inner and outer end portions; a pair of first load-supporting suspension means for hanging said telescopic inserts, by means of the outer end portions thereof, from opposite ends, respectively, of said roll-carrying length; and second load-supporting suspension means for hanging said roll-carrying length from an overhead hoist, the improvement wherein the outer end portion of each telescopic insert is provided with a rigidly interconnected assembly of operationally upstanding, rigid, connection structure rigidly attached thereto for attachment of one of said first load-supporting suspension means;

wherein each said assembly of rigid connection structure comprises a plate member secured to the outer end portion of the corresponding telescopic insert transversely thereof, and an operationally upstanding gusset plate member extending along and rigidly secured to the outer end portion of the corresponding telescopic insert;

wherein the pair of first load-supporting suspension means are respective link chains;

wherein the upper end of said gusset plate of each assembly of connection structure is provided with means for attaching a link of the corresponding link chain; and wherein means are provided adjacent to opposite ends of said roll-carrying length of structural material for attachment of links of said link chains, respectively.

2. Apparatus according to claim 1, wherein the roll-carrying length of structural material is reinforced lengthwise by truss-like structure.

3. Apparatus according to claim 1, including an overhead hoist from which the roll-carrying length is hung.

4. Apparatus according to claim 3, wherein the hoist is a trolley chain hoist, and the second suspension means is the chain component of said hoist.

* * * * *